United States Patent [19]

Sheridan

[11] Patent Number: 4,930,790

[45] Date of Patent: Jun. 5, 1990

[54] COMPOSITE COWL SEAL

[75] Inventor: Stephen E. Sheridan, Fond du Lac, Wis.

[73] Assignee: Brunswick Corporation, Skokie, Ill.

[21] Appl. No.: 206,525

[22] Filed: Jun. 14, 1988

[51] Int. Cl.[5] ..... B63H 21/00

[52] U.S. Cl. ..... 277/12; 277/186; 440/76; 440/77

[58] Field of Search ..... 277/12, 32, 181–184, 277/186, 226; 440/76, 77, 53, 900

[56] References Cited

U.S. PATENT DOCUMENTS

| | | | |
|---|---|---|---|
| 1,563,464 | 12/1925 | Bisland | 277/226 X |
| 2,367,409 | 1/1945 | Kuhler | 277/226 X |
| 2,487,669 | 11/1949 | Pattullo et al. | 277/181 X |
| 3,040,393 | 6/1962 | Dailey | 277/226 X |
| 4,470,608 | 9/1984 | Warren | 277/226 X |
| 4,613,310 | 9/1986 | Suzuki et al. | 440/76 |

FOREIGN PATENT DOCUMENTS

| | | | |
|---|---|---|---|
| 3414180 | 10/1985 | Fed. Rep. of Germany | 277/207 A |
| 60-60098 | 4/1985 | Japan | 440/76 |
| 61-222894 | 10/1986 | Japan | 440/77 |
| 62-155196 | 7/1987 | Japan | 440/77 |

*Primary Examiner*—Allan N. Shoap
*Assistant Examiner*—Jeff Hohenshell
*Attorney, Agent, or Firm*—Andrus, Sceales, Starke & Sawall

[57] ABSTRACT

A seal structure for placement at the joint between first and second cowl sections forms a seal between the cowl sections at two distinct locations. A resilient seal is formed at each sealing location, with one of the resilient seals being provided by a composite sealing construction. A flexible sealing strip for placement at the joint includes portions which form a pocket disposed between facing surfaces of the cowl sections, and a resilient cord placed within the pocket around the periphery of the joint. The pocket forming portions of the sealing strip can be moved to an open position so as to allow the strip to be satisfactorily stapled or otherwise connected to one of the cowl sections, as well as to allow placement of the cord within the pocket. The second resilient seal is provided by an enclosed air space disposed between another set of facing surfaces provided on the cowl sections.

6 Claims, 1 Drawing Sheet

COMPOSITE COWL SEAL

BACKGROUND AND SUMMARY

This invention relates to a seal for placement between abutting cowl sections of an outboard marine motor.

It is known to provide a sealing strip at the joint between abutting cowl sections of an outboard motor. However, in the past such a sealing strip has generally provided a single sealing surface between the cowl sections. Only a slight irregularity in the joint between the cowl sections causes the seal to lose its integrity, thereby leading to possible water entry into the interior of the cowl.

The present invention is directed to a structure for providing a double cowl seal at the joint between cowl sections. In accordance with the invention, a water resistant seal provided at the joint between abutting first and second cowl sections includes a sealing means adapted for placement at the joint. The sealing means provides a water resistant seal in at least two distinct and separate sealing locations at the joint. The invention also contemplates the provision of a composite seal between the abutting cowl sections. The sealing means, such as a sealing strip adapted for attachment to one of the cowl sections, is provided with a normally closed pocket which is disposed between facing surfaces of the cowl sections. The pocket, when in its normally closed position, includes outer surfaces which abut the facing surfaces of the cowl sections. A resilient member is adapted for placement within the pocket to provide a resilient seal between the cowl sections. The portions of the sealing strip which form the pocket are movable from the closed position, in which the pocket is formed, to an open position, which allows placement of the resilient member within the pocket. Additionally, movement of the portions of the sealing strip which form the pocket to the open position allows the strip to be stapled to one of the cowl sections. It is further contemplated that a resilient seal is provided at a second distinct sealing location. The second resilient seal is formed by providing an enclosed air space in the sealing strip. The enclosed air space is disposed between facing surfaces of the cowl sections so as to form a resilient seal therebetween.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
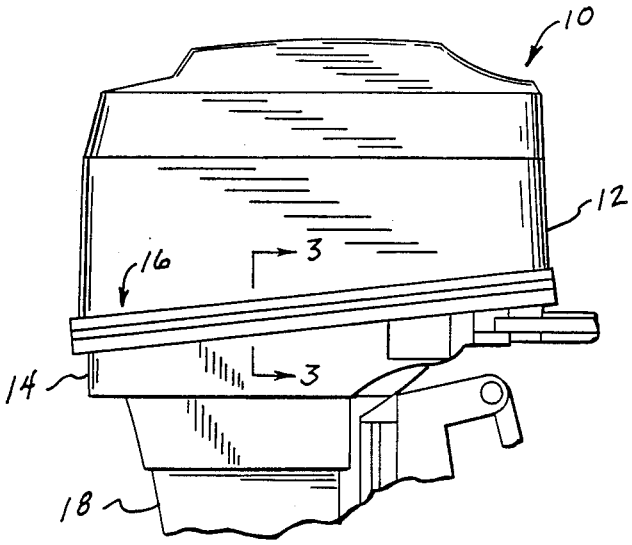
FIG. 1 is a partial side elevation view of a marine outboard motor showing the cowl seal of the invention.

As shown in FIG. 1, an outboard motor 10 is provided with a power head enclosed by an upper cowl section 12 and a lower cowl section 14. A joint, generally designated at 16, is formed between the abutting faces of upper and lower cowl sections 12, 14. As is well known, outboard motor 10 includes a depending gearcase 18 for transferring power from the power head to a propeller.

Figure 2:
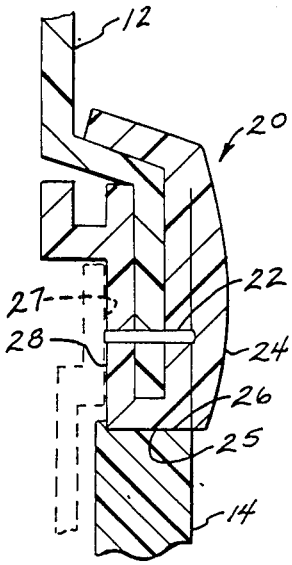
FIG. 2 PRIOR ART
FIG. 2 is a partial sectional view of a seal at the joint formed between upper and lower cowl sections showing a prior art seal having a single sealing surface.

FIG. 2 illustrates a prior art system for sealing joint 16. As shown in FIG. 2, a sealing strip is adapted for attachment to upper cowl section 12 via a series of staples, one of which is shown at 22. Strip 20 includes an outer flap 24 which is movable outwardly so as to allow strip 20 to be stapled to the lower edge of upper cowl section 12.

With the construction of strip 20 as shown in FIG. 2, only a single seal is provided between upper cowl section 12 and lower cowl section 14. At certain locations around the periphery of joint 16, lower cowl section 14 includes an upper surface 25 which is adapted to abut a lower downwardly facing surface 26 of sealing strip 20 so as to form a joint between upper and lower cowl sections 12, 14. At other locations about the periphery of joint 16, an outwardly facing surface 27 is provided on lower cowl section 14. Surface 27 is adapted for abutment to an inwardly facing sealing surface 28 provided on sealing strip 20 to form a seal between the cowl sections. As can be seen, with either of the illustrated constructions, a single seal is provided between upper and lower cowl, sections 12, 14.

Figure 3:
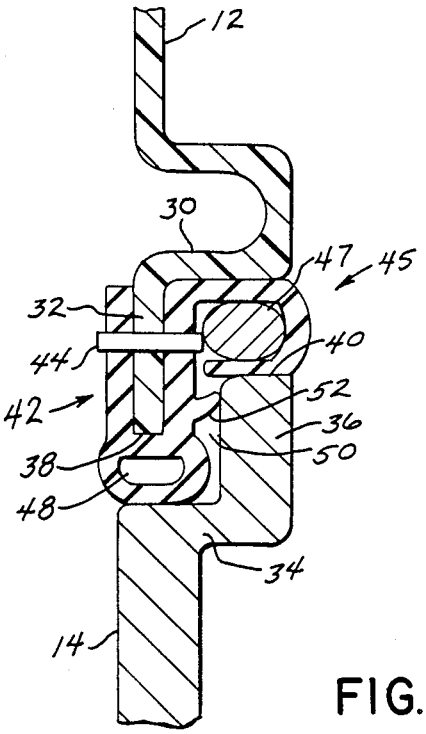
FIG. 3 is a partial sectional view taken generally along line 3-3 of FIG. 1 showing the cowl seal of the invention with the pocket in its normally closed position.

In accordance with the present invention, as shown in FIG. 3, upper cowl section 12 is provided with a lower shoulder 30 having a depending leg 32. In a like manner, lower cowl section 12 includes an upper shoulder 34 and an upstanding leg 36. Depending leg 32 of upper cowl section 12 includes a lower facing surface 38 which faces shoulder 34 of lower cowl section 14. Likewise, upstanding leg 36 includes an upper facing surface 40 which faces shoulder 30 formed on upper cowl section 12.

A flexible molded sealing strip, generally indicated at 42, is provided between upper and lower cowl sections 12, 14 at joint 16. Sealing strip 42 is constructed of an elastomeric compound of a durometer sufficient to provide resistance to collapse. Sealing strip 42 is adapted for attachment to depending leg 32 of upper cowl section 12 by means of a series of staples, one of which is illustrated at 44.

Figure 4:
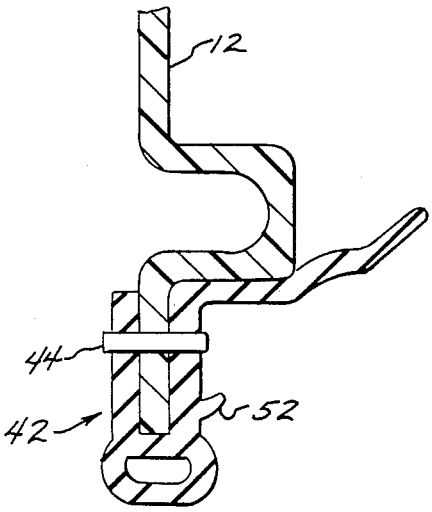
FIG. 4 is a view of the upper cowl section of FIG. 3, showing the sealing strip with the pocket in its open position..

As shown in FIG. 3, strip 42 is provided with a normally closed pocket, shown generally at 45. Pocket 45 is disposed between shoulder 30 and upwardly facing surface 40. With reference to FIG. 4, the portions of strip 42 which form pocket 45 can be moved from the normally closed position (FIG. 3) to an open position. When the pocket-forming portions of strip 42 are moved to the open position as shown in FIG. 4, the legs of the U-shaped portion of strip 42 can easily be stapled onto depending leg 32 of upper cowl section 12.

A resilient extruded cord, shown at 47, is adapted for placement within pocket 45. Resilient cord 47 is an elongated member formed of a suitable resilient material, such as an expanded cellular elastomeric foam. After strip 42 is stapled to upper cowl section 12, the portions of strip 42 which form pocket 45 are moved to the open position (FIG. 4) so as to allow cord 47 to be placed within the open pocket. After cord 47 is in position, the pocket-forming portions of sealing strip 42 are allowed to return to the closed position (FIG. 3) and to thereby enclose cord 47. This construction provides an outer resilient composite seal between shoulder 30 and upwardly facing surface 40 of upstanding leg 36. Additionally, the presence of resilient cord 47 prevents the collapse of pocket 45 of sealing strip 42 when strip 42 is formed around a corner.

Strip 42 includes a means for providing an inner resilient seal between upper and lower cowl sections 12, 14. To provide such a second resilient seal, an enclosed air pocket 48 is disposed between shoulder 34 of lower cowl section 14 and lower facing surface 38 of upper cowl section 12. The provision of air pocket 48 provides a structure for providing a resilient seal at joint 16 while accommodating a certain amount of intolerance therein.

As shown in FIG. 3, an air gap 50 is formed between the inner and outer resilient seals provided between upper and lower cowl sections 12, 14. Sealing strip 42 may include a resilient wing portion 52 adapted for placement within air gap 50 to form a third, or intermediate, seal at joint 16. Wing 52 is formed integrally with sealing strip 42, and is a resilient member which flexes to accommodate irregularities in joint 16.

The described construction provides a seal structure at joint 16 which includes an inner and outer seal with an intermediate seal therebetween. Upon abutting upper and lower cowl sections 12, 14 to form joint 16 and clamping such sections together by means of a suitable latch mechanism, the resilient nature of the inner and outer seals accommodates movement of cowl sections 12, 14 for maintaining a water tight joint 16 between sections 12, 14. The composite nature of the outer seal provides a highly satisfactory structure for allowing the sealing strip to be stapled to one of the cowl sections, and thereafter to provide a second resilient seal.

Various alternatives and modifications are contemplated as being within the scope of the following claims particularly pointing out and distinctly claiming the invention.

I claim:

1. A composite cowl seal adapted for placement at a joint formed between first and second cowl sections which enclose the power head of a marine propulsion system, comprising:

a seal member adapted for attachment to one of said cowl sections at said joint, said seal member including a pocket disposed between facing surfaces provided on said first and second cowl sections and having outer surfaces abutting said facing surfaces; and a resilient member disposed within said pocket for providing a water resistant seal between said cowl sections;

wherein portions of said seal member define said pocket when in a normally closed position for encasing said resilient member, and wherein said pocket defining portions of said seal member are movable to an open position for allowing insertion and removal of said resilient member to and from said pocket.

2. The assembly according to claim 1, wherein said seal member provides a second seal between said first and second cowl sections at a second sealing location distinct from the seal provided by said resilient member.

3. The composite cowl seal according to claim 2, wherein said second seal and the seal provided by said resilient member are separated by an air gap.

4. The composite cowl seal according to claim 2, wherein said seal member includes an enclosed air pocket at said second seal between said cowl sections.

5. A cowl seal for forming a water resistant seal at a joint between abutting first and second cowl sections which enclose the power head of a marine propulsion system, comprising sealing means adapted for placement at said joint between said first and second cowl sections, said sealing means providing a resilient water resistant seal between said sections in at least two distinct spaced sealing locations at said joint, wherein one of said resilient seals is provided by a composite seal at one of said sealing locations, said composite seal including a resilient member provided on said sealing means between said first and second cowl sections, said sealing means including an elongated sealing member adapted for attachment to one of said cowl sections and including a pocket in which said resilient member is disposed, wherein portions of said sealing member define said pocket when in a normally closed position, and wherein the portions of said sealing member defining said pocket are movable to an open position for allowing insertion and removal of said resilient member to and from said pocket.

6. The cowl seal according to claim 5, wherein said sealing member is adapted to be attached to one of said cowl sections by means of staples, and wherein movement of said pocket defining portions of said resilient member to said open position accommodates stapling of said resilient member to said cowl section.

* * * * *